US005546104A

United States Patent [19]

Kuga

[11] Patent Number: 5,546,104

[45] Date of Patent: Aug. 13, 1996

[54] DISPLAY APPARATUS

[75] Inventor: Kaeko Kuga, Kyoto, Japan

[73] Assignee: Rohm Co., Ltd., Kyoto, Japan

[21] Appl. No.: 350,179

[22] Filed: Nov. 30, 1994

[30] Foreign Application Priority Data

Nov. 30, 1993 [JP] Japan ..... 5-299794

[51] Int. Cl.[6] ..... G09G 5/34

[52] U.S. Cl. ..... 345/125; 345/121; 345/133

[58] Field of Search ..... 345/121, 122, 345/125, 3, 133, 49, 98

[56] References Cited

U.S. PATENT DOCUMENTS

| | | | |
|---|---|---|---|
| 4,469,449 | 9/1984 | Kato | 345/49 |
| 4,774,506 | 9/1988 | Bossoutrout | 345/122 |
| 4,860,246 | 8/1989 | Inoue | 345/3 |
| 5,025,394 | 6/1991 | Parke | 345/122 |
| 5,113,493 | 5/1992 | Crosby | 345/122 |

FOREIGN PATENT DOCUMENTS

0291252A2 11/1988 European Pat. Off. .

0494610A2 7/1992 European Pat. Off. .

OTHER PUBLICATIONS

Patent Abstracts of Japan, vol. 14, No. 568 (E-1014), Dec. 18, 1990 & JP-A-02 249 481.

Patent Abstracts of Japan, vol. 14, No. 573 (E-1015), Dec. 19, 1990 & JP-A-02 249 377.

*Primary Examiner*—Richard Hjerpe
*Assistant Examiner*—Kent Chang
*Attorney, Agent, or Firm*—Nikaido, Marmelstein, Murray & Oram LLP

[57] ABSTRACT

A memory is provided for storing one field of video signals supplied to a liquid crystal display panel serving as a display portion. Whether the video signals to be displayed have a stationary image portion or a moving image portion is determined by a comparator by comparing the video signals of the last field read out from the memory and the video signals of the present field supplied to the liquid crystal display panel. When it is determined that the video signals have a stationary image portion, the speed of scanning by a driver is reduced. When the scanning speed is low, the power required for the scanning is reduced.

6 Claims, 3 Drawing Sheets

DISPLAY APPARATUS

BACKGROUND OF THE INVENTION

1. Field of the Invention

The present invention relates to a display apparatus for use in an information processing apparatus, a communications apparatus, a video apparatus, a game apparatus and an apparatus mounted in a ship or a vehicle.

2. Description of the Prior Art

Conventionally, portable personal computers use liquid crystal displays of TFT (thin film transistor) active matrix type where a plurality of dots are horizontally and vertically arranged in a matrix. To display images, the supply voltage is supplied from a battery to the liquid crystal display panel to cause a driver to perform scanning.

Specifically, as shown in FIG. 1, this liquid crystal display has a plurality of signal electrodes 1, scanning electrodes 2, TFTs 3 and dot electrodes 4 formed in a matrix on the side of one insulating substrate (not shown), has common electrodes 5 formed on the side of the other insulating substrate (not shown) opposite thereto, and has a liquid crystal layer between the common electrodes 5 and the dot electrodes 4. Display with the dots is performed by line sequential scanning by the signal electrodes 1 and the scanning electrodes 2.

For example, when a scanning voltage is applied from a gate driver 6 to the scanning electrode 2 in the first line, the TFTs 3 in the first line connected thereto are activated to connect the signal electrodes 1 to the dot electrodes 4 in the first line, so that a signal voltage (i.e. video signal) is applied from a source driver 7 to the dots in the first line. By repeating such an application operation (scanning) for every line from the first line at a horizontal period, one field of video signals is displayed on the liquid crystal display, and by repeating this application operation every field, i.e. at a vertical period, the image is reproduced. The signal voltage is inverted every line and every field so that no direct current component is added to the liquid crystal display.

A liquid crystal driving voltage used in such a display apparatus is high because of the necessity of high duty, and the supply voltage supplied to the liquid crystal display panel is comparatively high. This increases the power consumed while the image is being displayed, which is a problem when the display apparatus is used, for example, in a portable apparatus having a power source such as a battery whose capacity is limited.

SUMMARY OF THE INVENTION

An object of the present invention is to provide a display apparatus in which the power consumption is reduced without the quality of the displayed image being greatly damaged.

A display apparatus of the present invention is provided with: display means having dots in a matrix; driving means for scanning the display means; a memory for storing therein a video signal supplied to the display means; determining means for determining whether a present input video signal corresponds to a stationary image portion or a moving image portion by comparing an input video signal of a last field stored in the memory and the present input video signal; and controlling means for reducing a speed of scanning by the driving means to be lower than a speed of scanning of the moving image portion when it is determined by the determining means that the present video signal corresponds to a stationary image portion.

With such features, for a moving image portion which shows a movement, the display of a video signal on the display portion is performed at a normal scanning speed to reproduce an image of high definition, so that the moving image is easily viewed. For a stationary image portion which shows no movement, since not very high definition is required and its visual after image effect can be used to the maximum, the scanning speed of the display portion is reduced to the minimum necessary for maintaining the image display to reduce the power consumption.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Hereinafter, a display apparatus for a personal computer using a liquid crystal display panel will be described as an embodiment of the present invention with reference to the drawings. According to this embodiment, in displaying images on the liquid crystal display panel, while the scanning of a moving image portion is performed at a normal scanning speed, the speed of scanning of a stationary image portion is reduced to the minimum necessary for maintaining the image display. Such a scanning control function is added to the display apparatus so that the display apparatus can cope with display for all kinds of apparatuses.

Figure 1:
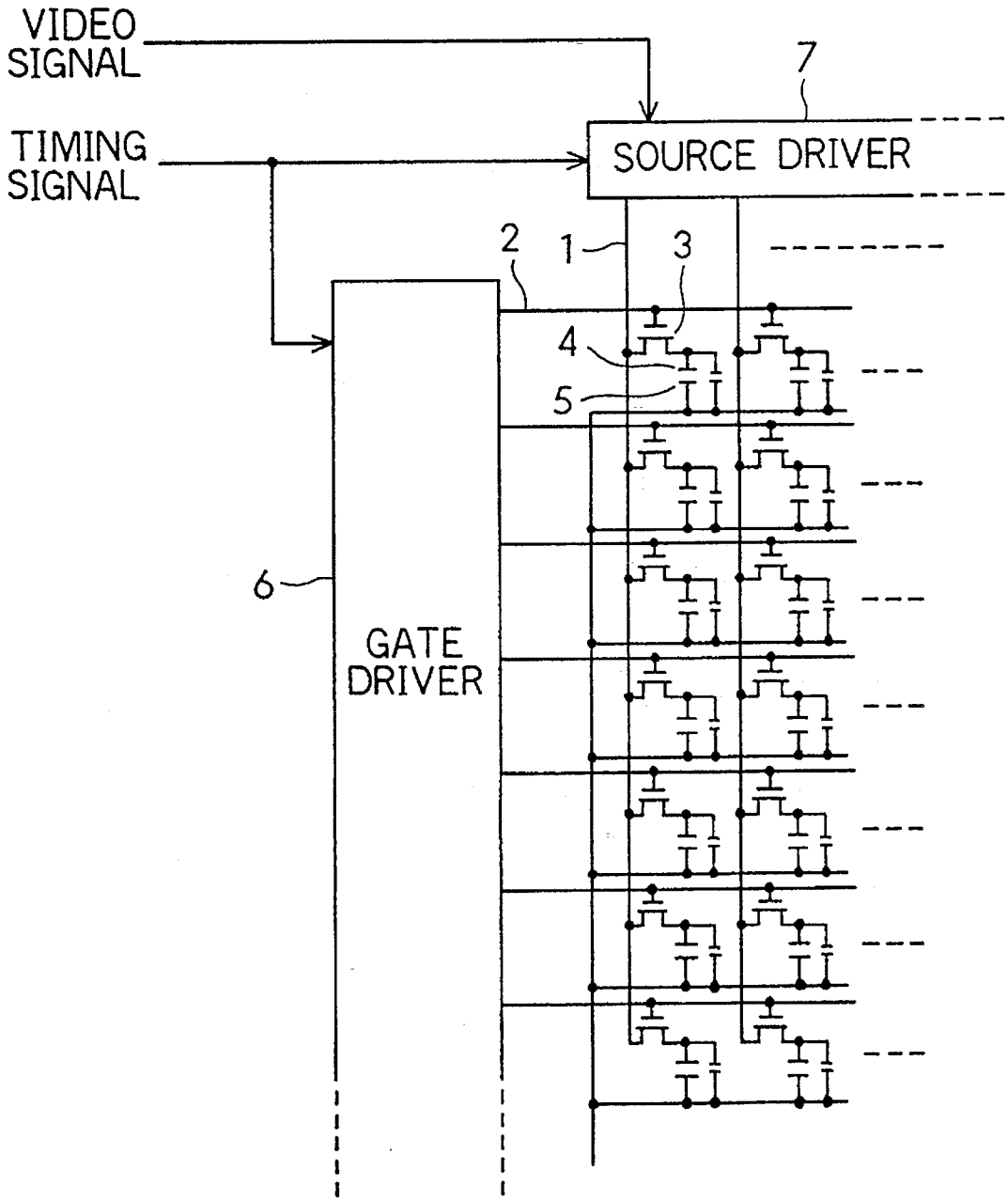
Fig. 1 Prior art
FIG. 1 is a view showing an example of driving of a conventional liquid crystal display panel.
Figure 2:
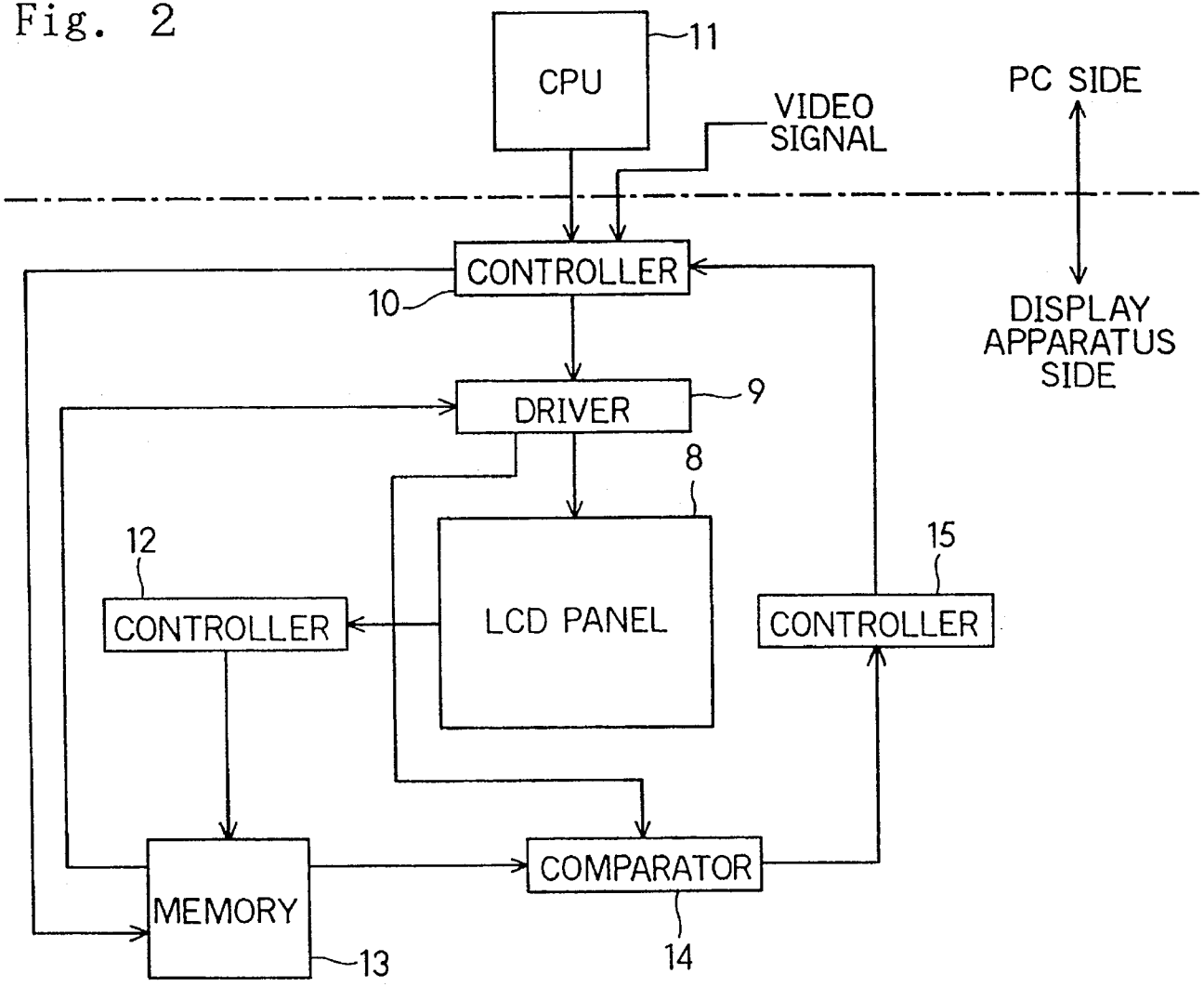
FIG. 2 is a view showing the arrangement of an embodiment of the present invention.

Specifically, this display apparatus is arranged as shown in FIG. 2. Reference numeral 8 represents a liquid crystal display panel of TFT active matrix type where a plurality of dots (in this case, 640×480 dots) are horizontally and vertically arranged in a matrix. Reference numeral 9 is a driver for causing the image display on the liquid crystal display panel 8 to be performed by line sequential scanning based on a timing signal from a controller 10. The driver 9 includes a gate driver which sequentially selects lines from the first to 480th lines and a source driver which applies a video signal to each of the dots, i.e. 640 dots, on the line selected by the gate driver. Like the prior art of FIG. 1, the liquid crystal display panel 8 has a plurality of signal electrodes 1, scanning electrodes 2, TFTs 3 and dot electrodes 4 in a matrix on the side of one insulating substrate (not shown), has common electrodes on the side of the other insulating substrate (not shown) opposite thereto, and has a liquid crystal layer between the common electrodes 5 and the dot electrodes 4. The liquid crystal display panel 8 has dots in matrix.

Reference numeral 11 is a central processing unit (CPU) provided in the personal computer to control the image display on the liquid crystal display panel 8. The CPU 11 controls the timing signal output from the controller 10 based on an input by an operation on a keyboard to control the image display on the liquid crystal display 8. Reference numeral 12 is a controller for taking out a video signal supplied from the personal computer to the liquid crystal display panel 8 to store it in a memory 13. The memory 13 is a non-volatile memory such as an electrically erasable programmable read only memory (EEPROM) or a ferro-electronic random access memory (FRAM) which requires no special battery backup apparatus, and stores in this case one field of video signals supplied to the liquid crystal display panel 8. The controller 12 writes the video signals of the present field in the memory 13 while reading out the video signals of the last field from the memory 13.

Reference numeral 14 represents a comparator which compares for every dot the video signals of the present field supplied to the liquid crystal display panel 8 with the video signals of the last field read out from the memory 13 to determine whether the video signals to be displayed correspond to a moving image portion or a stationary image portion. When the video signals of the present field are the same as the video signals of the last field, it is determined that the video signals to be displayed correspond to a stationary image portion. When the video signals are different, it is determined that the video signals to be displayed correspond to a moving image portion. Reference numeral 15 is a controller which controls the speed of scanning by the driver 9 through the controller 10 based on a determination by the comparator 14. For the image portion determined to be a stationary image portion, the controller 10 is controlled to supply the video signals of the last field read out from the memory 13 to the driver 9, and the speed of scanning by the driver 9 is reduced. Thus, the scanning speed is restrained, for example, to the minimum necessary for maintaining image display.

When the video signals of a display image having both a stationary image portion and a moving image portion are supplied to a display apparatus of such an arrangement, the portion where the video signals of the present field, before displayed, supplied from the driver 9 to the liquid crystal display panel 8 and the video signals of the last field stored in the memory 13 are not the same, i.e. the portion where the video signal is updated every field is determined to be a moving image portion by the comparator 14. The portion where the video signals of the present field before displayed and the video signals of the last field are the same is determined to be a stationary image portion by the comparator 14.

For the moving image portion determined in this manner, the video signals of the present field are displayed on the liquid crystal display panel 8 at a normal scanning speed, so that an image with a high definition is reproduced. For the stationary image portion, the speed of scanning by the driver 9 is reduced to the minimum (within a range where there is no problem in viewing the image) necessary for maintaining the image display and the video signals of the last field are displayed on the liquid crystal display panel 8, so that the power consumption is reduced.

Figure 3:
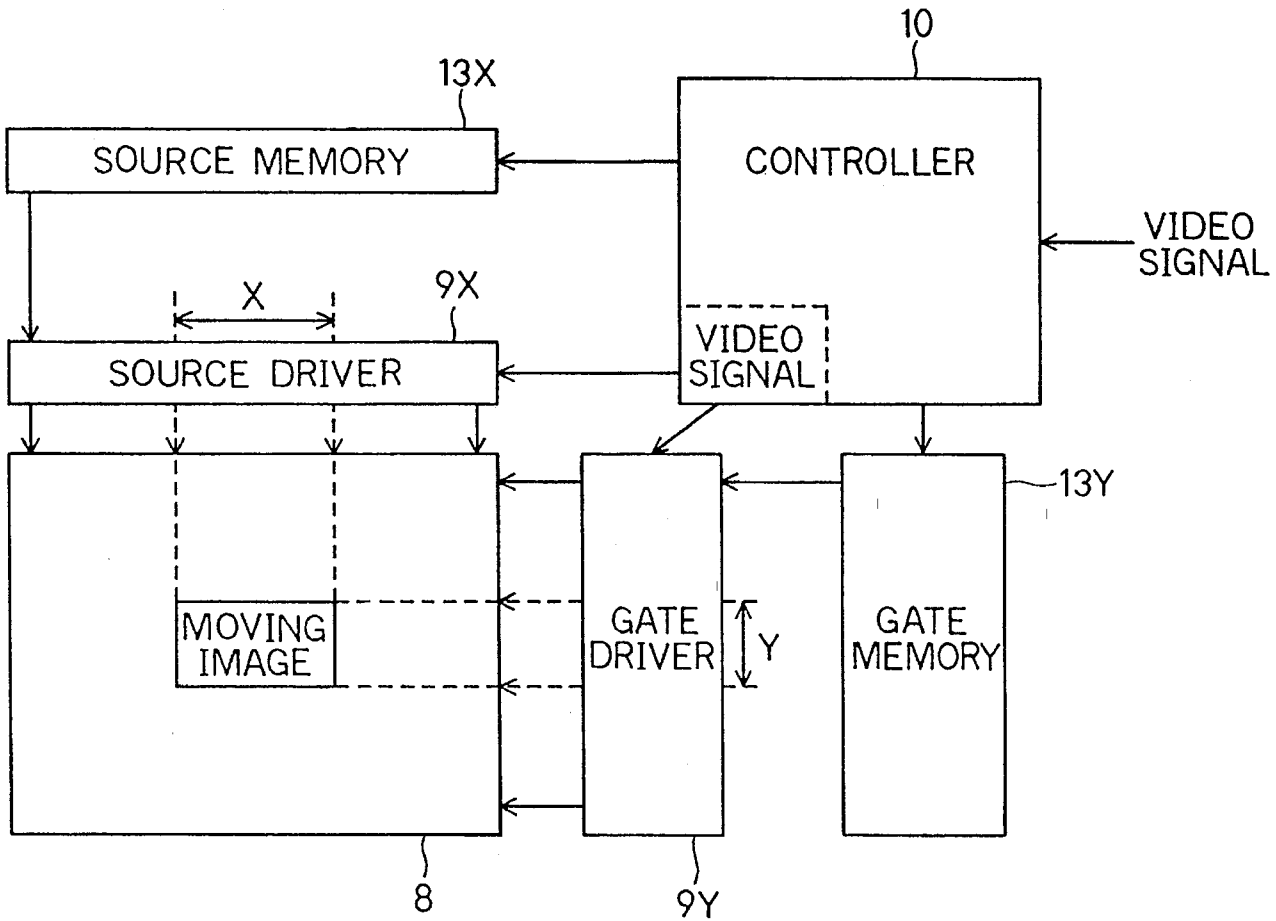
FIG. 3 is a view of assistance in explaining a scanning control of the embodiment of FIG. 2.

Specifically, when an X-Y portion of an image displayed on the liquid crystal display panel 8 is a moving image portion and the other portion is a stationary image portion as shown in FIG. 3, in the X-Y portion, video signals of the present field corresponding to the X-Y portion are supplied from drivers 9X and 9Y by way of the controller 10 at a normal scanning speed and displayed, and in the other portion, video signals from memories 13X and 13Y are supplied by the drivers 9X and 9Y at a scanning speed lower than the normal scanning speed and displayed. Here, 9X is a source driver, 9Y is a gate driver, and 13X and 13Y are memories corresponding to the gates 9X and 9X, respectively. Assuming that the stationary image portion is scanned at half of the scanning speed of the X-Y portion, the display of the upper half of the stationary image portion of the panel 8 and the display of all the X-Y portion end in the period of one field (the display of all the stationary image portion will end if thinned-out scanning is performed every line at the half speed).

When the X-Y portion is an icon which moves every field, the scanning of the stationary image portion at the next field is continuously performed after the completion of the scanning of the upper half (in the case of the thinned-out scanning, from the thinned-out line), so that one field of stationary images are displayed during the period of two fields. Since the drivers 9X and 9Y are each constituted by a plurality of drivers, the scanning timing of the moving image portion of the X-Y portion and the stationary image displayed portion of the other portion is adjusted so that the portions do not interfere with each other by adjusting the timing of use of the plurality of drivers constituting the drivers 9X and 9Y by the controller 10. The scanning of the stationary image portion is performed so that no direct current component is added to the liquid crystal display panel 8 due to the reduction in scanning speed. When this is not sufficient, another measure is taken.

Subsequently, in a second embodiment of the present invention, the determination as to whether a stationary image or a moving image is made every field. Specifically, when there is a moving image portion in one field, the field is treated as a moving image field, and when there is no moving image in one field, the field is treated as a stationary image field. Therefore, in this case, in the stationary image field, the scanning speed is half of the normal scanning speed, and in the moving image field, the normal scanning speed is used. The second embodiment is realized by using the circuit of FIGS. 1 and 2. The comparator 14 compares the video signals of the last field and the video signals of the present field for every dot. When at least one different signal is found therebetween, the field is determined to be a moving image field, and when all the signals of the fields are the same, the field is determined to be a stationary image field. As a result, the driver 9 performs scanning at half of the normal scanning speed in the stationary image field and at the normal speed in the moving image field. As a modification of the second embodiment, the threshold value of the number of different dots in one field is set to $K_0$ as a reference value of the stationary image field and the moving image field, and the comparator 14 determines that the field is a stationary image field when the number of different dots is equal to or below $K_0$ and that the field is a moving image field when the number of different dots exceeds $K_0$. $K_0$ is, for example, the value of 5 to 10% of all the numbers of dots.

While a TFT liquid crystal display panel is described in this embodiment, an STN liquid crystal display panel may be used. In that case, the liquid crystal display panel is driven by a segment driver and a common driver. As the display portion, an image receiving tube, a light emitting diode or a plasma display may be used. In the cases of these devices, the power consumption is also reduced by reducing the scanning speed of the stationary image portion.

As described above, according to the display apparatus of the present invention, for the moving image portion, the display of the video signals on the liquid crystal display panel 8 is performed at a normal scanning speed in order that the moving image portion is not damaged, and for the stationary image portion, the scanning speed of the display on the liquid crystal display panel is reduced to reduce the power consumption, so that a low-power-consumption display apparatus is realized with the image quality being hardly deteriorated.

Obviously, many modifications and variations of the present invention are possible in light of the above teachings. It is therefore to be understood that within the scope of the appended claims, the invention may be practiced other than as specifically described.

What is claimed is:

1. A display apparatus comprising:

display means having dots in a matrix;

driving means for scanning the display means;

a memory for storing therein a video signal supplied to the display means;

determining means for determining whether a present input video signal corresponds to a stationary image portion or a moving image portion by comparing an input video signal of a last field stored in the memory and the present input video signal; and controlling means for reducing a speed of scanning by the driving means to be lower than a speed of scanning of the moving image portion when it is determined by the determining means that the present video signal corresponds to the stationary image portion.

2. A display apparatus according to claim 1, wherein said display means is a liquid crystal display panel.

3. A display apparatus according to claim 1, wherein said memory is a non-volatile memory.

4. A display apparatus comprising:

display means having dots in a matrix;

driving means for scanning the display means;

a memory for storing therein a video signal supplied to the display means;

determining means for determining whether a present field is a stationary image field or a moving image field by comparing an input video signal of a last field stored in the memory and an input video signal of a present field; and controlling means for reducing a speed of scanning by the driving means to be lower than a speed of scanning of the moving image field when it is determined by the determining means that the present field is the stationary image field.

5. A display apparatus according to claim 4, wherein said determining means determines that the present field is a moving image field when video signals of at least a predetermined number of dots are different than the last, and determines that the present field is a stationary image field when the number of different dots is equal to or below the predetermined number.

6. A display apparatus according to claim 4, wherein said display means is a liquid crystal display panel and said memory is a non-volatile memory.

* * * * *